US008310213B2

(12) United States Patent
Hlavac

(10) Patent No.: US 8,310,213 B2
(45) Date of Patent: Nov. 13, 2012

(54) ELECTRICAL COMPONENT FAULT DETECTION

(75) Inventor: Pavel Hlavac, Plzen (CZ)

(73) Assignee: Brush SEM s.r.o., Pizen (CZ)

( * ) Notice: Subject to any disclaimer, the term of this patent is extended or adjusted under 35 U.S.C. 154(b) by 473 days.

(21) Appl. No.: 12/603,432

(22) Filed: Oct. 21, 2009

(65) Prior Publication Data

US 2010/0134075 A1 Jun. 3, 2010

(30) Foreign Application Priority Data

Oct. 22, 2008 (GB) ..... 0819355.9

(51) Int. Cl.
*H02K 11/00* (2006.01)
*G08B 21/00* (2006.01)

(52) U.S. Cl. ..... 322/99; 340/645; 340/638; 340/639

(58) Field of Classification Search ..... 322/99; 340/638, 639, 645
See application file for complete search history.

(56) References Cited

U.S. PATENT DOCUMENTS

| | | | | | |
|---|---|---|---|---|---|
| 3,793,572 | A | * | 2/1974 | Canay | 318/718 |
| 3,930,189 | A | * | 12/1975 | Smith | 318/52 |
| 3,940,680 | A | * | 2/1976 | Tadokoro et al. | 104/289 |
| 4,225,851 | A | | 9/1980 | Reschovsky et al. | 340/870.04 |
| 4,242,666 | A | | 12/1980 | Reschovsky et al. | 340/870.28 |
| 4,354,190 | A | | 10/1982 | Reschovsky | 340/870.18 |
| 4,377,784 | A | * | 3/1983 | Saito et al. | 324/765.01 |
| 4,565,998 | A | | 1/1986 | Tsuji et al. | 340/645 |
| 4,635,044 | A | * | 1/1987 | South | 340/638 |
| 4,635,045 | A | * | 1/1987 | Miller et al. | 340/638 |
| 4,757,717 | A | | 7/1988 | Wolfinger et al. | 73/660 |
| 4,952,915 | A | * | 8/1990 | Jenkins et al. | 340/639 |
| 5,828,146 | A | * | 10/1998 | Lorenz et al. | 310/68 D |
| 6,693,778 | B1 | | 2/2004 | Pittman et al. | 361/42 |
| 6,777,839 | B2 | | 8/2004 | Casey et al. | 310/68 D |
| 6,794,879 | B2 | | 9/2004 | Lawson et al. | 324/509 |
| 6,876,102 | B2 | | 4/2005 | Alappat | 307/18 |
| 7,633,259 | B2 | * | 12/2009 | Fish | 318/721 |
| 7,804,270 | B2 | * | 9/2010 | Kadah | 318/782 |
| 8,155,902 | B2 | * | 4/2012 | Yin et al. | 702/65 |
| 8,193,782 | B2 | * | 6/2012 | Mori et al. | 322/33 |
| 2002/0140433 | A1 | | 10/2002 | Lawson et al. | 324/509 |
| 2008/0024941 | A1 | * | 1/2008 | Fish | 361/33 |
| 2009/0230914 | A1 | * | 9/2009 | Kadah | 318/782 |
| 2011/0216449 | A1 | * | 9/2011 | Reschovsky et al. | 361/18 |
| 2012/0105021 | A1 | * | 5/2012 | Sandrana et al. | 322/99 |

(Continued)

FOREIGN PATENT DOCUMENTS

| | | |
|---|---|---|
| CA | 1143029 | 3/1983 |

(Continued)

OTHER PUBLICATIONS

UK Search Report for corresponding Application No. GB0819355.9 dated Feb. 18, 2009.

(Continued)

*Primary Examiner* — Pedro J Cuevas
(74) *Attorney, Agent, or Firm* — Knobbe Martens Olson & Bear, LLP

(57) ABSTRACT

A motive unit, such as a generator, is disclosed. The motive unit has a fault transmitter to provide a status indication of a component of the motive unit. Failure of a component, such as a diode on the rotor of a generator, can be accordingly communicated.

17 Claims, 8 Drawing Sheets

U.S. PATENT DOCUMENTS

| | | | | |
|---|---|---|---|---|
| 2012/0105239 | A1* | 5/2012 | Levi | 340/638 |
| 2012/0148254 | A1* | 6/2012 | Yamauchi | 398/135 |

FOREIGN PATENT DOCUMENTS

| | | |
|---|---|---|
| CN | 201107369 | 8/2008 |
| EP | 0444337 | 2/1990 |
| GB | 1039100 | 8/1966 |
| GB | 1493919 | 11/1977 |
| GB | 2464698 | 12/2011 |
| JP | 04207944 | 7/1992 |
| JP | 11215899 | 8/1999 |

OTHER PUBLICATIONS

UKIPO Examination Report for corresponding Application No. GB0819355.9 dated Jul. 21, 2011.

Response submitted to UK Intellectual Property Office for corresponding Application No. GB0819355.9 dated Sep. 21, 2011.

* cited by examiner

ELECTRICAL COMPONENT FAULT DETECTION

CROSS REFERENCE TO RELATED APPLICATIONS

This application claims priority under 35 U.S.C. §119 to Great Britain Patent Application Number 0819355.9, filed on Oct. 22, 2008, the disclosure of which is hereby expressly incorporated herein by reference.

BACKGROUND

1. Field of the Invention

The field relates to detection of failing electrical components in a moving part, e.g. on board a rotor of an AC generator or other motive unit comprising parts that move relative to one other.

2. Description of the Related Technology

A common configuration of synchronous AC generators involves using an auxiliary AC generator mounted on the same shaft as the main generator field to provide excitation current for the main generator field winding. The auxiliary generator is generally known as a rotating exciter. In this arrangement the exciter typically has a 3 phase rotating armature connected to a 3 phase rotating diode rectifier which converts the AC exciter output to DC for feeding to the main generator field winding.

It is common practice to use two series connected diodes in each limb of the rotating rectifier. This ensures that if any one diode fails, such that it becomes conducting in reverse bias mode then the healthy second diode in the limb will block reverse current allowing the exciter-rectifier arrangement to continue providing excitation current to the main generator field winding. If the second diode in the particular rectifier limb fails in the same way then the rotating exciter effectively sees a line-to-line short circuit which can cause serious damage to the machine.

Some embodiments provide an indication, e.g. to maintenance personnel, when a single electrical component (for example a diode) fails so that the faulty component can be replaced before a further failure that could cause serious damage.

SUMMARY OF CERTAIN INVENTIVE ASPECTS

One aspect includes a motive unit comprising a moving part comprising a first electrical component connected to a circuit;

a fault transmitter connected to the first component and configured to transmit an optical status signal indicating a status of the first component; and a stationary part comprising a receiver configured to receive the optical status signal from the fault transmitter and to thereby provide a status indication of the first component.

Some aspects provide an alarm indication if an electrical component in the moving part fails.

Some aspects provide an indication to maintenance personnel when a single electrical component fails so that the faulty electrical component may be replaced before further failures and associated damage occurs.

Some aspects provide a method of installing a fault detection system in a motive unit comprising the steps of:

connecting a fault transmitter to a first electrical component in a moving part of the motive unit, the fault transmitter being configured to transmit an optical status signal indicating a status of the first component; and installing a receiver in a stationary part of the motive unit, the receiver being configured and positioned to receive the optical status signal from the fault transmitter and to thereby provide a status indication of the first component during relative movement of the moving and stationary parts.

BRIEF DESCRIPTION OF THE DRAWINGS

Embodiments are described by way of example, and with reference to the accompanying drawings in which.

DETAILED DESCRIPTION OF CERTAIN INVENTIVE EMBODIMENTS

Figure 1:
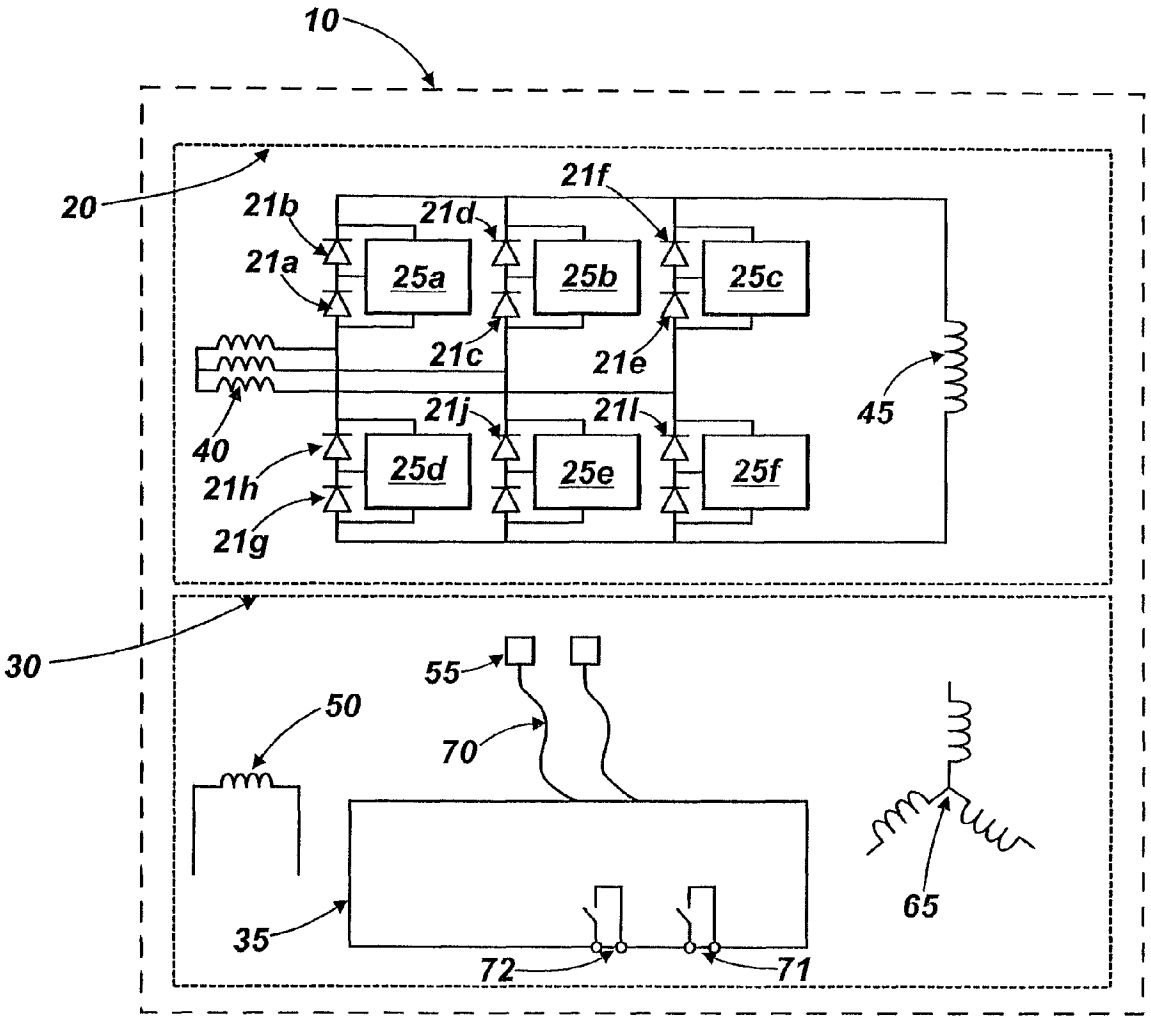
FIG. 1 shows a schematic diagram of the fault detection system.

Referring to FIG. 1, an AC generator 10 comprises a rotor 20 and a stator 30. The stator 30 is arranged to surround the rotor; however this arrangement could be reversed so that the stator 30 is surrounded by the rotor 20.

In this embodiment, the rotor 20 comprises generator field winding 45, exciter armature winding 40, rectifier diodes 21*a*-1, and diode fault transmitter (DFT) units 25*a-f*. Each phase of the exciter armature 40 is connected to respective rectifier diodes 21, and the diodes 21 are connected to the generator field winding 45. The generator field winding 45 is then connected to further rectifier diodes 21 to form three circuit loops/six circuit branches. The rectifier diodes 21 are configured to permit current flow in only one direction throughout each circuit loop, between the generator field winding 45 and the exciter armature 40.

Each circuit branch between the exciter armature 40 and the generator field winding 45 comprises two rectifier diodes 21. However each branch could alternatively comprise a different number of diodes. Diode fault transmitters 25*a-f* are each connected across a respective pair of rectifier diodes 21.

The stator 30 comprises generator armature winding 65, exciter field winding 50, and a number of fiber optic sensor heads 55 connected by fiber optic cables 70 to a diode fault receiver unit 35. The receiver 35 is arranged to be in communication with each diode fault transmitter 25 via the fiber optic cables 70 and fiber optic sensor heads 55.

Figure 2:
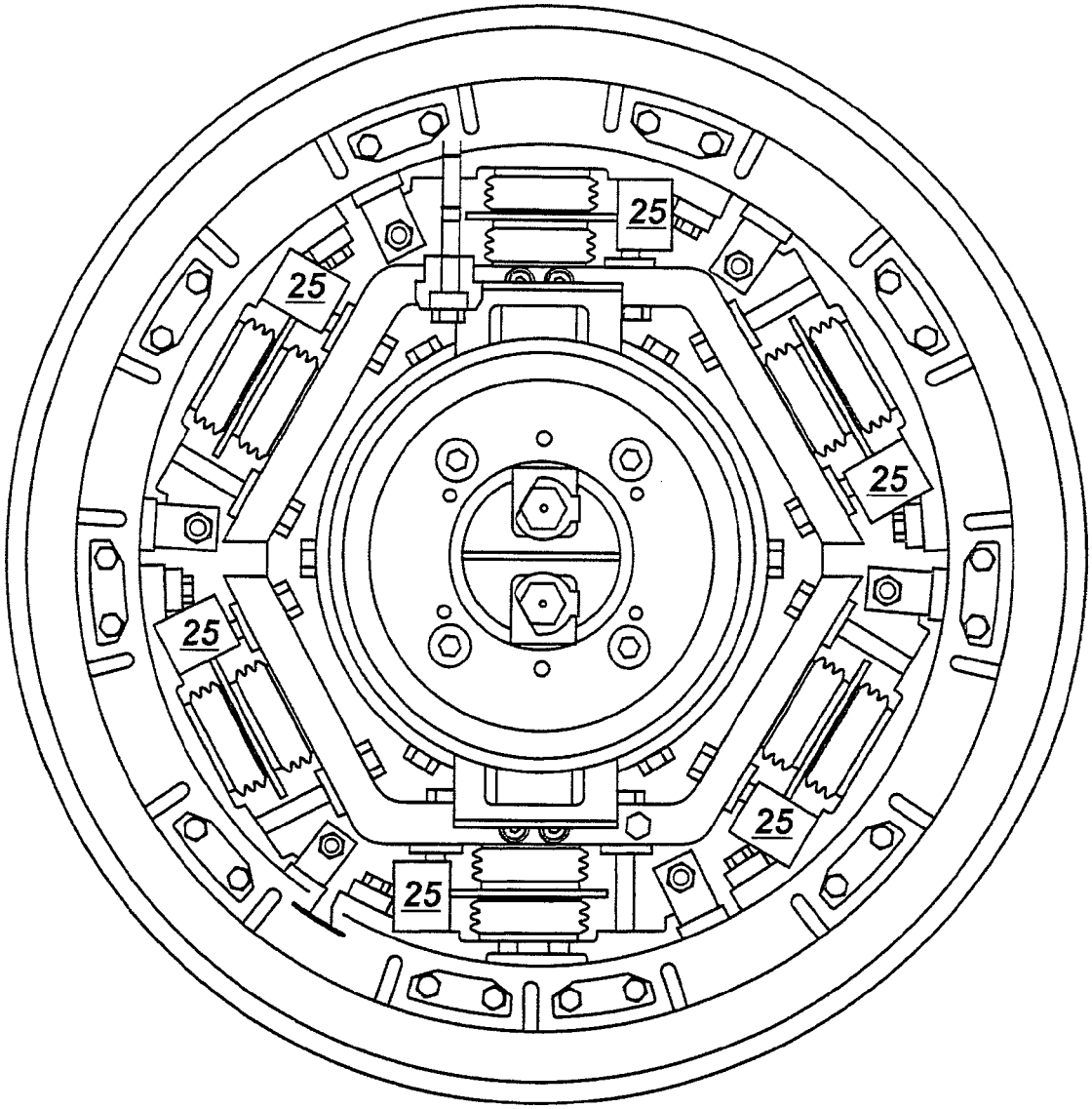
FIG. 2 shows a set of six diode fault transmitter (DFT) units that are installed on a rotor such as that shown in FIG. 1.
Figure 4:
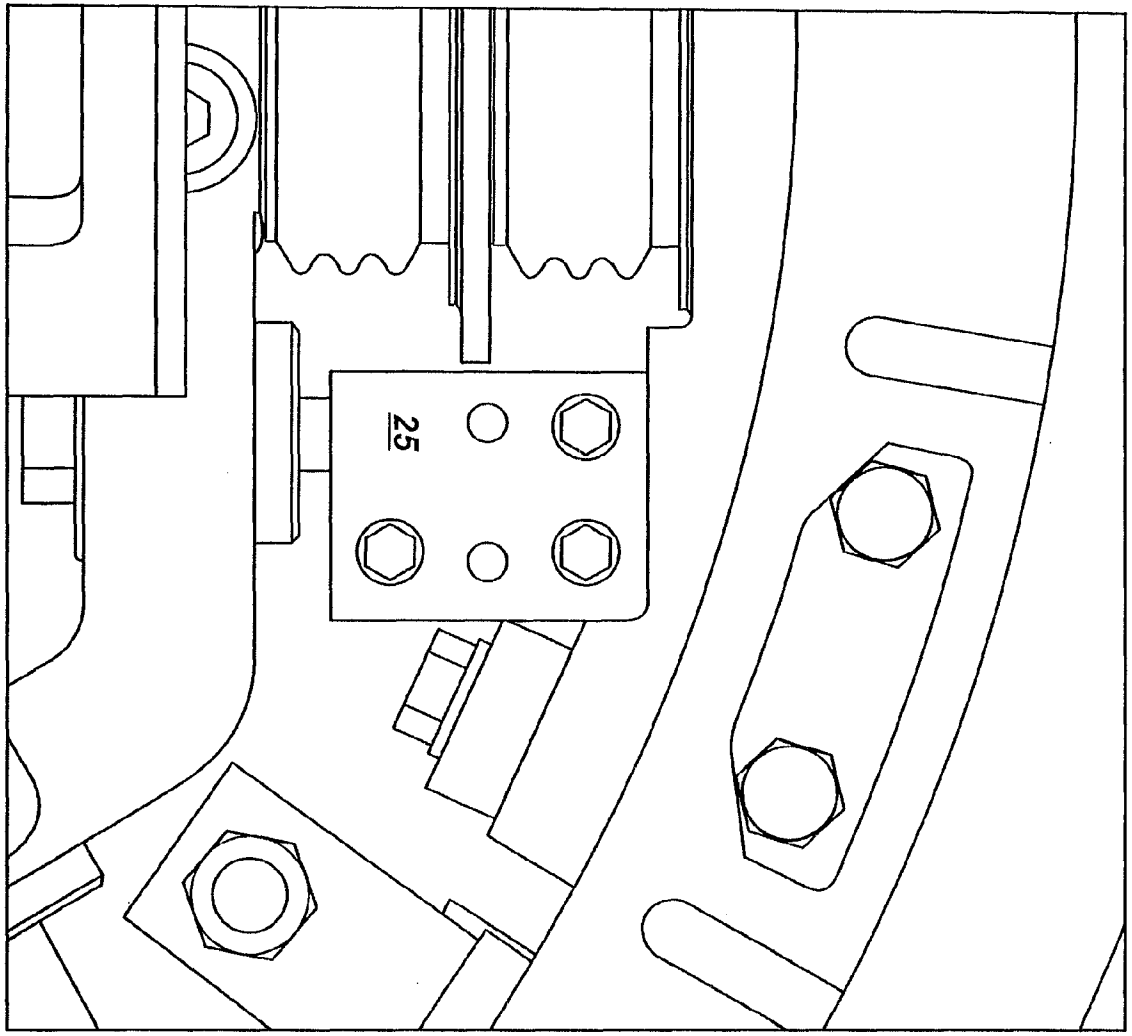
FIG. 4 shows a close up view showing a single DFT installed on a rotor such as that shown in FIG. 1.

As shown in FIGS. 2 and 4, each diode fault transmitter 25 may be installed in generator 10 as a bolt-on component of the diode fault detection system described herein. In some embodiments, the detection system is installable as a retrofit diode fault detection system to an existing generator.

Figure 3:
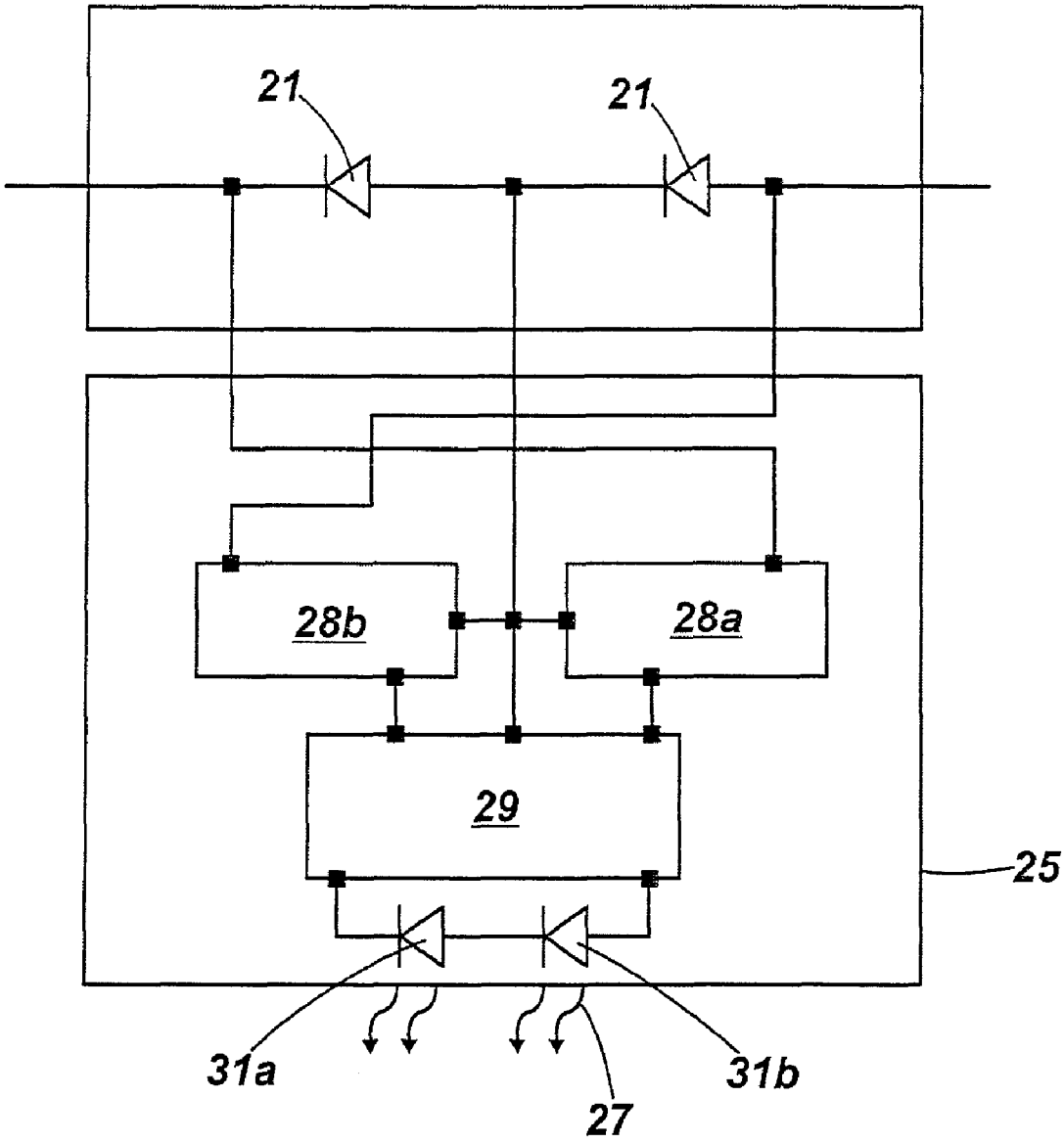
FIG. 3 shows a schematic diagram of the diode fault transmitter connected across diodes to be monitored.

In some embodiments, as shown in FIG. 3, each diode fault transmitter (DFT) 25 uses a pair of current sources as sensors 28*a*, 28*b*, one connected across each diode to detect a reverse bias voltage across the respective diode. The diode fault transmitter is adapted to transmit an optical signal 27 (e.g. a pulse of light) each time the pair of diodes changes from reverse biased state to start conducting, i.e. the transmitter acts as a fault detector that detects when a fault occurs across respective connected diodes 21, and indicates (transmits) the functionality of the connected diode via the optical signal 27. If either diode fails, then the particular diode fault transmitter ceases transmitting light pulses. The diode fault receiver 35 is configured to receive the signal 27 from each respective diode fault transmitter 25 and to thereby provide an output indication of the correct functioning of each diode 21.

The expression 'optical' signal is intended to encompass the infra-red, visible and ultra-violet portions of the electromagnetic spectrum.

Referring to FIG. 3 again, the diode fault transmitter 25 comprises sensors 28*a-b*, a control circuit 29 and LEDs 31*a-b*. Each diode fault transmitter 25 may comprise any number of sensors 28 and/or LEDs 31; it is sometimes beneficial for the number of sensors 28 to be equal to the number of rectifier diodes 21 connected to a respective diode fault transmitter 25.

In this embodiment, each sensor 28 is connected in parallel across a respective rectifier diode 21. The sensors 28 are connected to the control circuit 29. The control circuit 29 is connected to the LEDs 31. Other light emitting components may be used other than LEDs, for example, laser diodes.

When a diode 21 is faulty or becomes faulty, current may be able to flow across it in either direction, i.e. in a forward direction and also in reverse. A functioning diode will have a detectable reverse bias voltage across it, whilst a faulty diode will not. Sensors 28 may be configured to detect a reverse bias voltage across their respective rectifier diode 21, a reverse bias voltage therefore being indicative of the correct functionality of a connected diode 21.

Control circuit 29 is configured to operate the LEDs 31 to transmit an optical signal 27 when reverse bias is detected on both diodes and to cease operating the LEDs 31 when reverse bias voltage is not detected on one of the diodes.

Figure 5A:
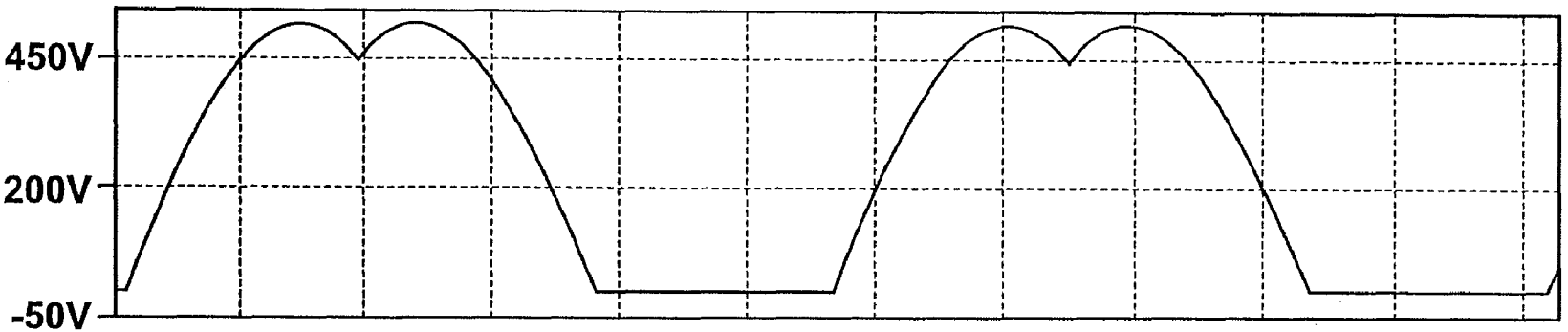
FIG. 5*a* shows an approximation to the diode voltage measured by a diode fault transmitter.
Figure 5B:
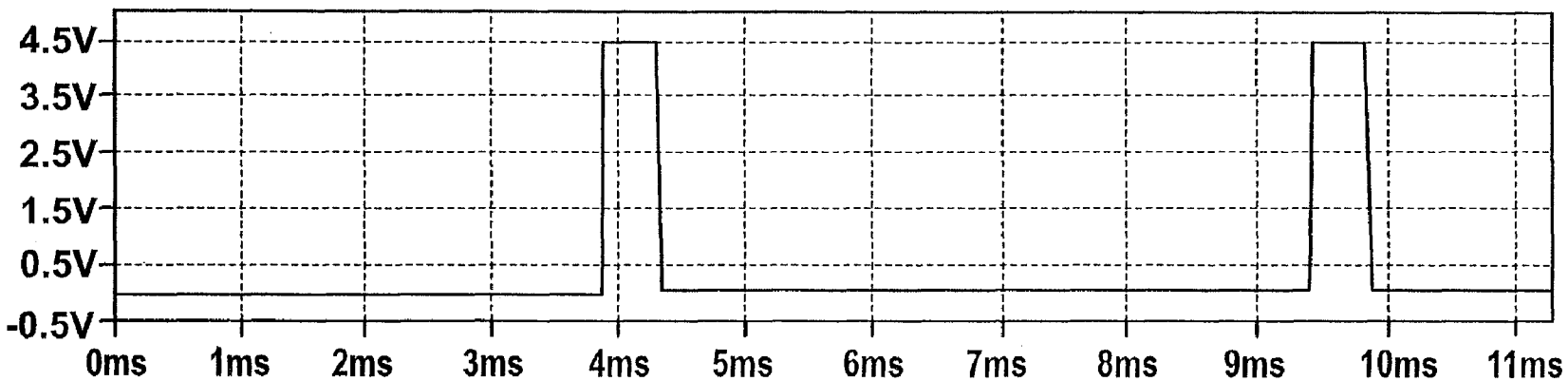
FIG. 5*b* shows the electrical output from the diode fault transmitter.

Referring to FIGS. 5*a* and 5*b*, when the diode fault transmitter 25 detects the reverse bias voltage of a correctly rectified input signal (FIG. 5), it outputs an optical signal every electrical cycle of the exciter armature voltage waveform immediately after each period when the diodes are reversed biased. In this way the reverse bias voltage of each healthy diode can be used as a power source to transmit the optical signal (see FIGS. 5*a* & 5*b*).

Components for the diode fault transmitters 25 may be suitable for different generator types that have different specifications, specifically those with different exciter output voltage rating.

Referring to FIG. 1, the receiver 35 uses the fiber optic cables to connect to fiber optic sensor heads 55 located within the stator 30, i.e. the sensor heads are non-rotating.

Figure 6:
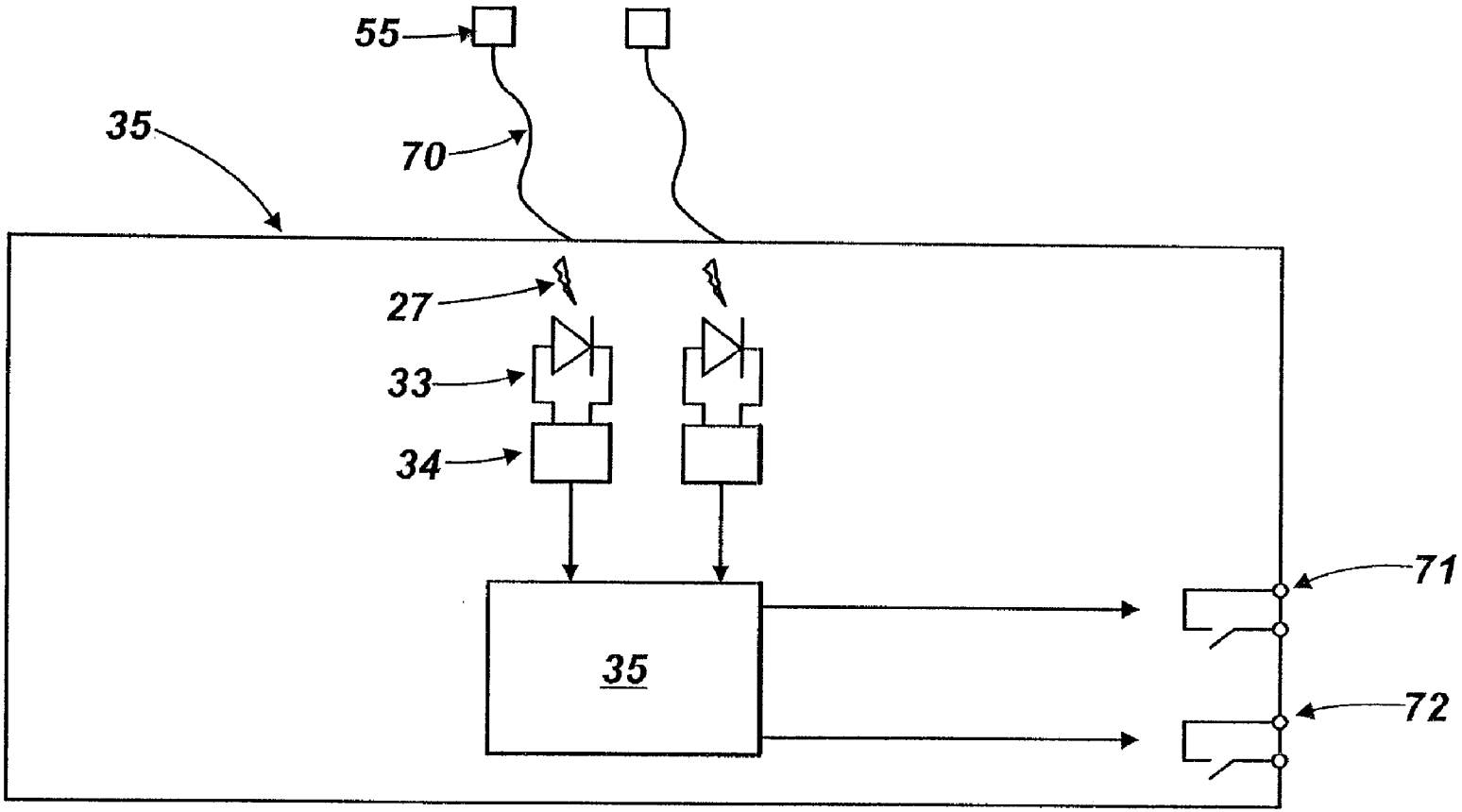
FIG. 6 shows a receiver circuit.
Figure 7:
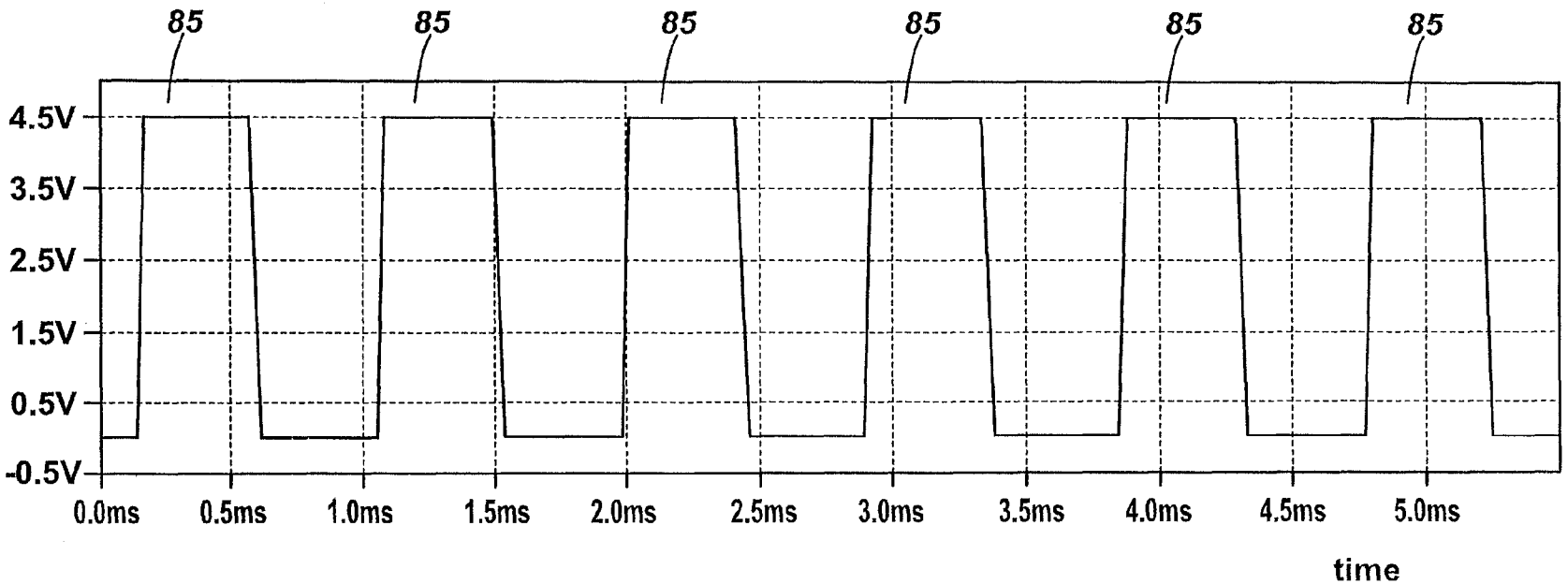
FIG. 7 shows a succession of optical signals received when no diode faults are detected.

FIG. 6 shows a more detailed schematic diagram of the diode fault receiver 35 of FIG. 1. Photodiodes 33 are connected to a signal receiver device 34 which is connected to a microcontroller 36.

The sensor heads 55 are positioned to receive the optical signals 27 transmitted by the diode fault transmitters 25 mounted on the rotor 20. The fiber optic cables 70 transmit the optical signals 27 to the photodiodes 33. The photodiodes 33 receive the optical signals 27 from each of the diode fault transmitters 25 and convert these to electrical signals to provide a component status signal sensed by signal receiver device 34. The signal receiver device 34 is configured to transmit the component status signals 27 (now in electrical form) to the microcontroller 36. Microcontroller 36 is configured to provide an output indication 72 of a diode fault if any one or more of a succession of expected optical signals 27 is not received.

As the diode fault transmitters 25 are mounted on a rapidly rotating frame (rotor 20) relative to the stator 30, the fiber optic cables providing the sensor heads can be conveniently positioned within the stator 30 in a position optimized to receive the optical signals 27 transmitted by the diode fault transmitters 25 while still allowing flexibility in the positioning of the receiver 35. As the rotor 20 rotates, each LED 31 is successively brought into brief optical communication with a sensor head of the fiber optic cables. The optical signals 27 transmitted by the LEDs are received by the sensor heads and fed into the fiber optic cables for transmission to the receiver 35. The photodiodes 33 receive the optical signals and the receiver device 34 converts them into an electrical signal which is analyzed by the microcontroller 36.

Positioning the diode fault transmitters 25 immediately adjacent to their respective diodes may be advantageous in that it avoids the need for any flexible wiring connection between the diodes 21 and the transmitters 25. Flexible wiring, particularly if not adequately supported, could be susceptible to failure in or on a rapidly rotating component. Thus, in some embodiments, the fault transmitters 25 may be disposed immediately adjacent to or on the same substrate as the respective components (e.g. diodes) being monitored without flexible wiring from the component to the fault transmitter.

Providing a diode fault transmitter 25 for each series connected pair of diodes may also be advantageous in that extended wiring connections are avoided and a failed individual diode fault transmitter is unlikely to cause another fault transmitter to fail and can readily be replaced. In some embodiments, identical diode fault transmitters are provided for each pair of diodes so that component exchange is easy and the number of spare parts required for maintenance is reduced.

Due to the rotation of the rotor 20 relative to the stator 30, the optical signals 27 received are synchronous with the exciter waveform of the generator 10.

In operation, when each pair of diodes is established to be healthy (i.e. functional) each diode fault transmitter (DFT) 25 transmits an optical signal once per electrical cycle of the exciter output voltage waveform. The exciter is a synchronous generator so that for each complete revolution of the rotor each DFT will transmit its optical signal once for each pair of exciter poles. The mechanical angular positions of the rotor 20 at the times of transmission will be approximately the same for transmission of optical signals by all DFTs 25. Transmission by all the diode fault transmitters 25 will occur at the same approximately fixed angular positions of the rotor as transmission by each other DFT and therefore optical receiver heads are only needed in a single area of the stator 30. Slight variation in position for transmission will occur due to changes in rotor load angle. To accommodate such variations and to provide increased system integrity more than one optical receiver head may be used.

Figure 8:
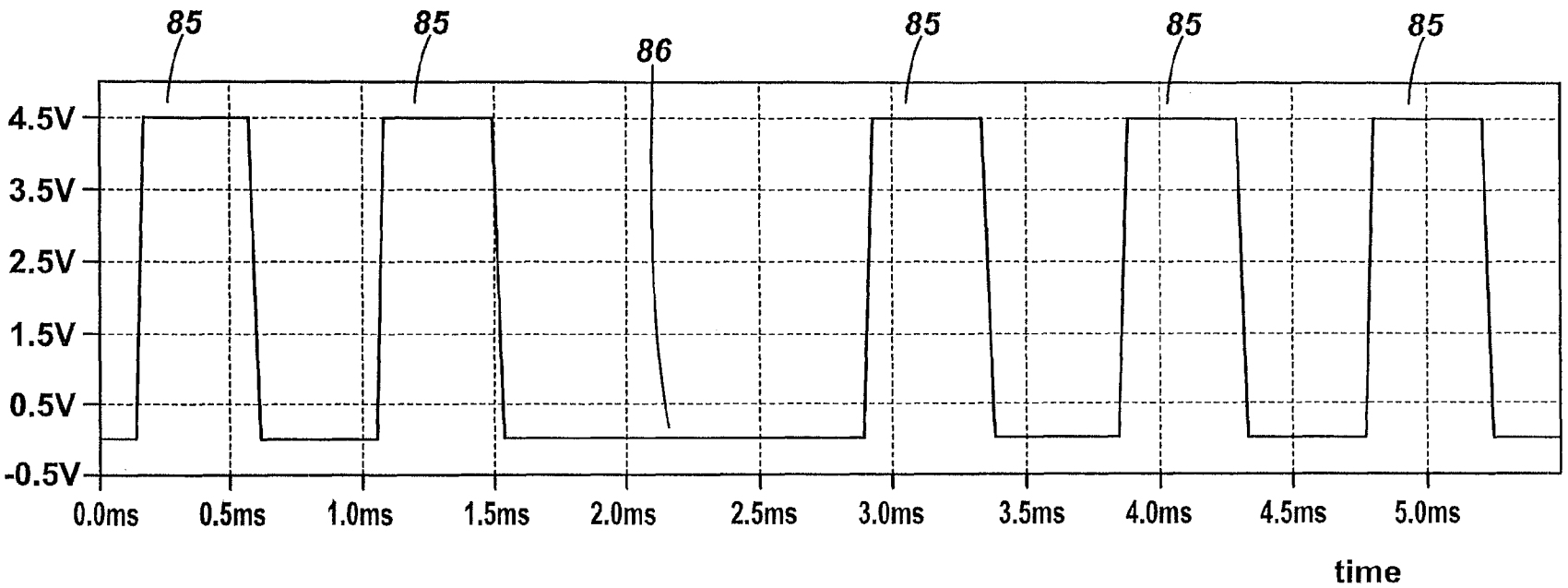
FIG. 8 shows a succession of optical signals received when a diode fault is detected.

For each pair of diodes the receiver can expect to receive an optical signal 85 at certain points in time as shown in FIGS. 8 and 9.

A diode that has developed a fault or has failed will result in missing optical signals (compared to the expected signals), e.g. at time 86 on FIG. 8. These missing signals will be understood by the receiver microcontroller 36 to be indicative of diode failure and an output indication 72 will be given accordingly. The diode fault receiver may determine the validity of optical status signals using the value of exciter field current, rotation speed or other additional signal, if desired.

Use of the fiber optic cable allows the diode fault receiver 35 to be conveniently mounted for easy connection of a power source and fiber optic cables 70 whilst also enabling the fiber optic sensor heads 55 to be positioned in an optimum location within the stator 30 for good light reception of the optical signals 27 from diode fault transmitters 25.

Referring again to FIG. 1, the diode fault receiver 35 comprises output indicators 71 and 72. The signal receiver device 34 can measure strength of the optical signal so that degradation of the signal can be differentiated from complete signal loss. The diode fault receiver 35 thus operates output indicator 71 when there is no detected diode fault and received optical signals indicate functionality of the diodes 21. The receiver 35 operates output indicator 72 when there is a detected diode fault. Output indicator 72 may be configured to automatically shut down the generator 10 when a fault is detected so as to avoid damage to the generator 10.

It will be recognized that the transmission of optical signals by the diode fault transmitters 25 each time correct functionality of a diode is detected provides a fail-safe mechanism in that it is the absence of an appropriately timed signal 86 (FIG. 9) that indicates failure.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A motive unit comprising:

a moving part comprising a first electrical component connected to a circuit;

a fault transmitter connected to the first electrical component and configured to transmit an optical status signal indicating a status of the first electrical component; and a stationary part comprising a receiver configured to receive the optical status signal from the fault transmitter and to generate a status indication of the first electrical component based on the optical status signal, wherein the unit is a generator, the moving part comprises a rotor, and the stationary part comprises a stator, wherein the first electrical component comprises a rectifier diode connected between an exciter armature and a generator field winding, and wherein the first electrical component includes a series pair of rectifier diodes connected between the exciter armature and the generator field winding, and the fault transmitter is configured to transmit the optical status signal in response to correct operation of both diodes.

2. The unit of claim 1, wherein the optical status signal is active when correct operation of the first electrical component is detected, and the status indication indicates correct operation of the first electrical component in response to the active optical status signal.

3. The unit of claim 2, wherein the first electrical component is a diode and the optical status signal is activated in response to a reverse bias voltage being detected across the diode, and the status indication indicates the reverse bias across the first electrical component.

4. The unit of claim 3, wherein the fault transmitter is configured to use the reverse bias voltage across the functioning respective connected diode to provide power to transmit the optical status signal.

5. The unit of claim 1, wherein the rotor comprises a plurality of exciter armature windings connected to the generator field winding by rectifier diodes each connected to a respective fault transmitter.

6. The unit of claim 1, wherein the receiver is configured to receive a succession of optical status signals from the transmitter upon rotation of the rotor.

7. The unit of claim 6 wherein the receiver is configured to provide an output indication of a diode fault if any one or more of the succession of optical signals is not received.

8. The unit of claim 6 further including means for determining the validity of optical status signals using a value of exciter field current or rotation speed.

9. The unit of claim 1 in which the receiver includes an optical fiber having a sensor head end positioned for reception of the optical status signal from the moving part.

10. A generator, comprising:

a rotor comprising a series pair of rectifier diodes connected between an exciter armature and generator field winding;

a fault transmitter connected to the series pair of rectifier diodes and configured to transmit an optical status signal indicating a status of the series pair of rectifier diodes only when correct operation of both diodes in the series pair is detected; and a stator comprising a receiver configured to receive the optical status signal from the fault transmitter and to thereby provide a status indication of the series pair of rectifier diodes.

11. The generator of claim 10, wherein the receiver is configured to provide an output indication of the correct operation of the series pair of rectifier diodes.

12. The generator of claim 11, wherein the fault transmitter is configured to transmit said optical status signal only when a reverse bias voltage is detected across both of the diodes, and wherein the receiver is configured to provide an output indication of the reverse bias across the diodes.

13. The generator of claim 12, wherein the fault transmitter is configured to use the reverse bias voltage across the functioning diodes to provide power to transmit the optical status signal.

14. The generator of claim 10, wherein the rotor comprises a plurality of exciter armature windings each connected to the generator field winding by pairs of series rectifier diodes, each of the respective pairs of series rectifier diodes being connected to a respective fault transmitter.

15. The generator of claim 10, wherein the receiver is configured to receive a succession of optical status signals from the transmitter upon rotation of the rotor.

16. The generator of claim 10, wherein the receiver is configured to provide an output indication of a diode fault if any one or more of the succession of optical signals is not received.

17. A method of installing a fault detection system in a generator, the method comprising:

connecting a fault transmitter to a series pair of rectifier diodes connected between an exciter armature and a generator field winding in a rotor of the generator, the fault transmitter being configured to transmit an optical status signal indicating a status of the series pair of rectifier diodes only when correct operation of both diodes in the series pair is detected; and installing a receiver in a stator of the generator, the receiver being configured and positioned to receive the optical status signal from the fault transmitter and to thereby provide a status indication of the series pair of rectifier diodes during relative movement of the rotor and the stator.

* * * * *